US008293334B2

(12) United States Patent
Hackbarth et al.

(10) Patent No.: US 8,293,334 B2
(45) Date of Patent: Oct. 23, 2012

(54) PRELIMINARY METALLIZING TREATMENT OF ZINC SURFACES

(75) Inventors: Karsten Hackbarth, Duesseldorf (DE); Wolfgang Lorenz, Erkrath (DE); Eva Wilke, Haan (DE); Marcel Roth, Duesseldorf (DE); Reiner Wark, Wuppertal (DE); Michael Wolpers, Erkrath (DE); Guadalupe Sanchis Otero, Duesseldorf (DE); Christian Rosenkranz, Duesseldorf (DE); Peter Kuhm, Hilden (DE); Kevin Meagher, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 12/621,206

(22) Filed: Nov. 18, 2009

(65) Prior Publication Data

US 2010/0209732 A1 Aug. 19, 2010

Related U.S. Application Data

(63) Continuation of application No. PCT/EP2008/055308, filed on Apr. 30, 2008.

(30) Foreign Application Priority Data

May 4, 2007 (DE) ..... 10 2007 021 364

(51) Int. Cl.
*C23C 18/08* (2006.01)
*C23C 18/16* (2006.01)

(52) U.S. Cl. ..... 427/437; 427/435; 427/436; 427/438; 427/404; 427/304; 427/383.1; 148/24; 106/1.05; 106/1.12; 106/1.22; 106/1.27

(58) Field of Classification Search ..... 148/253, 148/24; 106/14.12, 1.05, 1.12, 1.22, 1.27; 427/304, 383.1, 404, 435, 436, 437, 438
See application file for complete search history.

(56) References Cited

U.S. PATENT DOCUMENTS 5,298,289 A 3/1994 Lindert et al.
5,449,415 A * 9/1995 Dolan ..... 148/259
5,942,052 A 8/1999 Kamimura et al.
(Continued)

FOREIGN PATENT DOCUMENTS

CH 361954 1/1954
(Continued)

OTHER PUBLICATIONS

PCT International Search Report dated Nov. 6, 2008, International Application PCT/EP2008/055308.

*Primary Examiner* — Lois Zheng
(74) *Attorney, Agent, or Firm* — Mary K. Cameron

(57) ABSTRACT

The invention relates to a method for a preliminary metallizing treatment of galvanized or zinc alloy-coated steel surfaces or joined metallic parts that at least partly have zinc surfaces, in a surface treatment encompassing several process steps. In the disclosed method, metallic coats of especially a maximum of 100 mg/m$^2$ of molybdenum, tungsten, cobalt, nickel, lead, tin, and/or preferably iron are produced on the treated zinc surfaces. Another embodiment of the invention relates to an uncoated or subsequently coated metallic part which has been subjected to the disclosed preliminary metallizing treatment as well as the use of such a part for making bodies during the production of automobiles, building ships, in the construction industry, and for manufacturing white products.

46 Claims, 4 Drawing Sheets

U.S. PATENT DOCUMENTS 6,530,999 B2 * 3/2003 Meagher et al. ..... 148/262

FOREIGN PATENT DOCUMENTS

| | | | |
|---|---|---|---|
| CN | 1050572 | A | 4/1991 |
| DE | 171455 | | 4/1904 |
| DE | 1238742 | B | 4/1967 |
| DE | 1918275 | | 8/1972 |
| DE | 1816930 | | 6/1976 |
| DE | 2103086 | C3 | 11/1979 |
| DE | 19733972 | A1 | 2/1999 |
| DE | 19923084 | A1 | 11/2000 |
| DE | 102004041142 | A1 | 3/2006 |
| DE | 102007001654 | A1 | 7/2008 |
| JP | 198257188663 | | 11/1982 |
| JP | 1992048095 | A | 2/1992 |
| WO | WO 2004101850 | A1 | 11/2004 |
| WO | WO 2009/041616 | | 4/2009 |

* cited by examiner

| Example | Photograph |
|---|---|
| V1 |  |
| V2 |  |
| V3* |  |
| B1 |  |
| B2 |  |

V2 B1

V1: IIb → IVa

V3: IIa → IIIa → IVb

B1: I → IIa → IIIa → IVb

V1 V3 B1

PRELIMINARY METALLIZING TREATMENT OF ZINC SURFACES

This application is a continuation under 35 U.S.C. §§120 and 365 of International Patent Application No. PCT/EP2008/055308, filed Apr. 30, 2008, which claims the benefit of earlier filed German Patent Application No. 10 2007 021 364.8 filed May 4, 2007, the entire disclosure of each of which is hereby incorporated herein by reference.

FIELD OF THE INVENTION

The present invention relates to a method for metallizing pretreatment of galvanized and/or alloy-galvanized steel surfaces or joined metal parts, at least partially having zinc surfaces, in a surface treatment comprising multiple process steps. In the inventive process, metallic layer coatings of in particular no more than 100 mg/m$^2$ molybdenum, tungsten, cobalt, nickel, lead, tin and/or preferably iron are created on the treated zinc surfaces. Such metallized zinc surfaces are excellently suited as the starting material for the subsequent passivation and coating steps (FIG. 1, methods II-V) and create a much higher efficiency of the anticorrosion coating, in particular after the inventive pretreatment of galvanized metal surfaces. Application of the method to galvanized steel plate suppresses corrosive delamination of the paint coating, especially at cut edges. In another aspect, the invention therefore comprises an uncoated or subsequently coated metallic component to which an inventive metallizing pretreatment has been applied as well as the use of such a component in vehicle body production in automobile manufacturing, in shipbuilding, in the construction industry and for the production of white goods.

BACKGROUND OF THE INVENTION

At the present, a variety of surface-finished steel materials are manufactured in the steel industry and today almost 80% of the fine sheet metal products in Germany are supplied in a surface-finished form. For the production of products, these fine sheet metal products are processed further, so that a wide variety of different metallic materials or a wide variety of combinations of metallic base materials and surface materials may be present in one part and, to meet certain product requirements, must be present. In further processing, especially of surface-finished steel plate, the material is cut to size, shaped and joined by welding or adhesive bonding methods. These processing operations are typical to a great extent of vehicle body production in the automobile industry, where mainly galvanized steel plate from the coil coating industry is processed further and joined to ungalvanized steel plate and/or aluminum plate, for example. Vehicle bodies consist of a multitude of sheet metal parts joined together by spot welding.

From this variety of combinations of metallic sheet materials in one part and the primary use of surface-finished steel plates, special requirements are derived for corrosion protection, which must be capable of reducing the consequences of bimetal corrosion as well as corrosion at cut edges. Although metallic zinc coatings applied to steel plate electrolytically or in a melt-dip process impart a cathodic protective effect, which prevents active dissolution of the more noble core material at cut edges and mechanically induced damage to the zinc coating, it is equally important to reduce the corrosion rate per se to ensure the material properties of the core material. Requirements of the corrosion prevention coating, consisting of at least one inorganic conversion layer and one organic barrier layer are high accordingly.

At cut edges and at any damage to the zinc coating caused by processing or other influences, the galvanic coupling between the core material and the metallic coating produces an active unhindered local dissolution of the coating material, which in turn constitutes an activation step for corrosive delamination of the organic barrier layer. The phenomenon of debonding of paint or "blistering" is observed especially at cut edges, where unhindered corrosion of the less noble coating material occurs. The same thing is also true in principle for the locations on a part where different metallic materials are joined together directly by joining techniques. Local activation of such a "defect" (cut edge, damage to the metal coating, spot welds) and thus corrosive debonding of paint emanating from these "defects" are all the more pronounced, the greater the electric potential difference between the metals in direct contact. Equally good results with regard to paint adhesion at cut edges are offered by steel plate with zinc coatings alloyed with more noble metals, e.g., iron-alloyed zinc coatings (Galvannealed steel).

The producers of steel plate have been relying to an increasing extent on integrating other corrosion coatings, in particular paint coatings, into the plate mill, in addition to surface finishing with metallic coatings, so there is an increased demand for anticorrosion treatments capable of effectively preventing the problems associated with corrosion of cut edges and contact corrosion in adhesion of paint there and also in the processing industry, in particular in automotive manufacturing.

Various pretreatments which address the problem of edge protection are known in the prior art. The essential strategy being pursued here is to improve adhesion of the organic barrier layer to the surface-finished steel plate.

Unexamined German Patent DE 19733972, which describes a method of alkaline passivating pretreatment of galvanized and alloy-galvanized steel surfaces in metal plate mills, is to be considered the most proximate prior art. In this method, the surface-finished steel sheet is brought in contact with an alkaline treatment agent containing magnesium ions, iron(III) ions and a complexing agent. The zinc surface is passivated, forming the anticorrosion layer, at the predefined pH of more than 9.5. According to the teaching of DE 19733972, a surface passivated in this way offers paint adhesion comparable to that of methods using nickel and cobalt. Optionally this pretreatment for improving corrosion protection may be followed by other treatment steps, such as a chromium-free post-passivation, before applying the paint system. It has nevertheless been found that this pretreatment system is unable to satisfactorily suppress the debonding of paint caused by corrosion at cut edges.

SUMMARY OF THE INVENTION

An object of the present invention is to provide a method for pretreatment of galvanized and alloy-galvanized steel surfaces that will definitely improve the debonding of paint caused by defects in the zinc layer on the steel plate, in particular at cut edges, in comparison with the prior art.

This object was achieved by a method for metallizing pretreatment of galvanized and alloy-galvanized steel surfaces, where the zinc surface is brought in contact with an aqueous agent (1) at a pH no higher than 9, wherein cations and/or compounds of a metal (A) are present in the agent (1) whose redox potential $E_{redox}$ measured on a metal electrode of the metal (A) at a predefined process temperature and concentration of cations and/or compounds of the metal (A) in the aqueous agent (1) is more anodic than the electrode potential $E_{Zn}$ in the galvanized or alloy-galvanized steel surface in contact with an aqueous agent (2), which differs from the agent (1) only in that it does not contain any cations and/or compounds of the metal (A).

DETAILED DESCRIPTION OF THE INVENTION

The inventive method is suitable for all metal surfaces, e.g., steel plate and/or joined metal parts, consisting at least in part of zinc surfaces, e.g., vehicle bodies. The combination of ferrous surfaces and zinc surfaces as materials is especially preferred.

Figure 1:
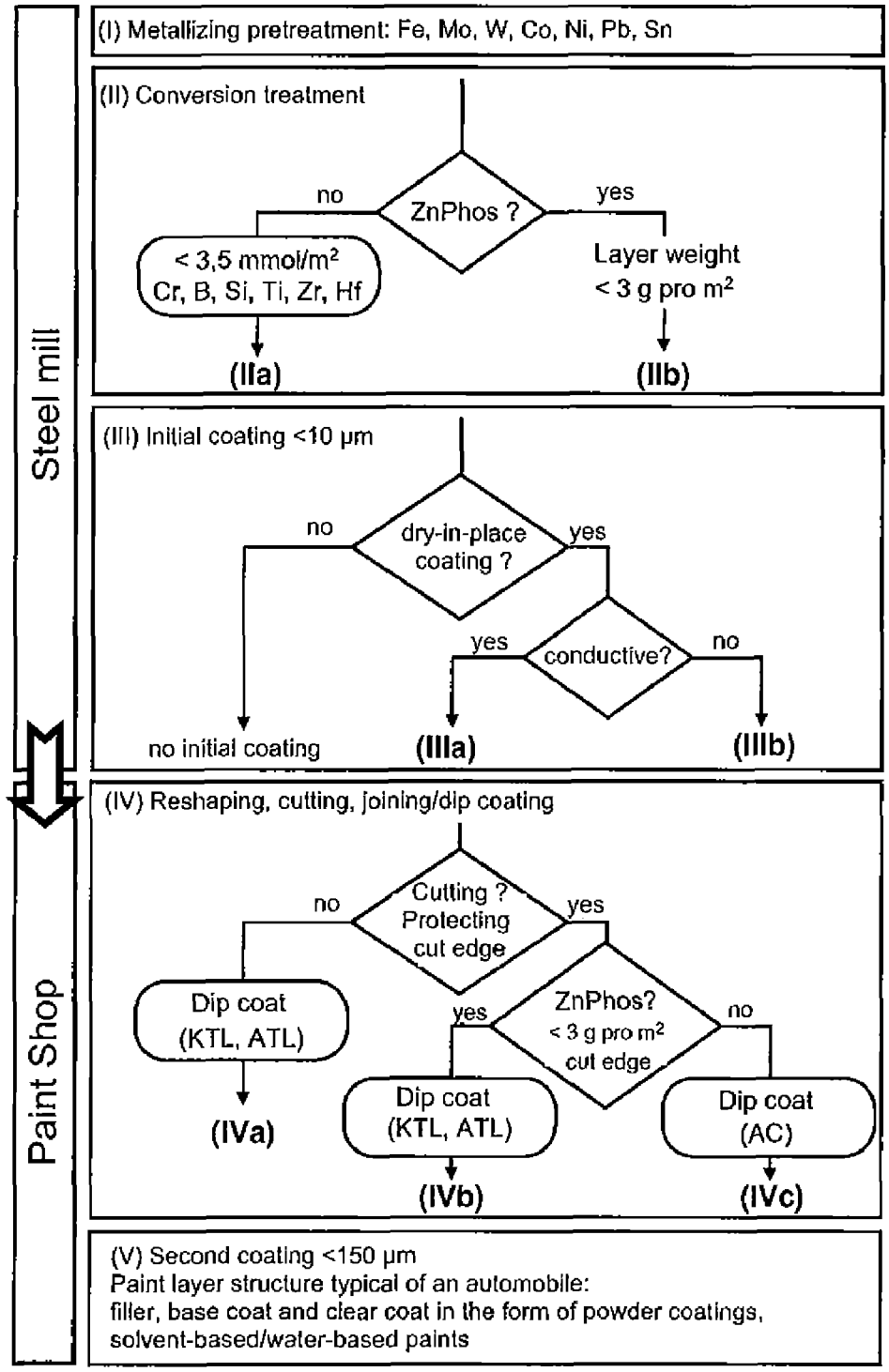
FIG. 1 shows an overview diagram of corrosion-preventing coating methods based on the inventive metallizing pretreatment.

The term "pretreatment" in the sense of the present invention is understood to refer to passivation by means of inorganic barrier layers (e.g., phosphating, chromating) or a process step which precedes the paint coating for conditioning the cleaned metal surface. Such conditioning of the surface means an improvement in corrosion prevention and paint adhesion for the entire layer system resulting at the end of the process chain for corrosion-protected surface treatment. FIG. 1 summarizes typical process chains in the sense of the present invention which benefit from the inventive pretreatment to a particular extent.

The specifying designation of the pretreatment as "metallizing" is to be understood as a pretreatment process, which directly induces a metallic deposition of metal cations (A) on the zinc surface, whereby after a successful metallizing pretreatment, at least 50 at % of the element (A) is present on the zinc surface in the metallic state in accordance with the analytical method defined in the example portion of the present patent application.

According to the present invention, the redox potential $E_{redox}$ is measured directly in the agent (1) on a metal electrode of the metal (A) with respect to a commercial standard reference electrode, e.g., a silver chloride electrode. For example, in an electrochemical measuring chain of the following type:

$E_{redox}$ in volt: Ag/AgCl/1M KCl//metal (A)/M(1)

where Ag/AgCl/1M KCl=0.2368 V with respect to a standard hydrogen electrode (SHE), where M(1) denotes the inventive agent (1) containing cations and/or compounds of the metal (A).

The same thing is also true of the electrode potential $E_{Zn}$ determined on a zinc electrode in the agent (2), which differs from the agent (1) only in the absence of the cations and/or compounds of the metal (A), with respect to a commercial standard reference electrode:

$E_{Zn}$ in volt: Ag/AgCl/1M KCl//Zn/M(2)

The inventive method is now characterized in that a metallizing pretreatment of the zinc surface is performed when the redox potential $E_{redox}$ is more anodic than the electrode potential $E_{Zn}$; this is the case when $$E_{redox}-E_{Zn}>0.$$

The potential difference of redox potential $E_{redox}$ and electrode potential $E_{Zn}$ according to the above definitions is to be regarded as the electromotor force (EMF), i.e., as the thermodynamic driving force for currentless metallizing pretreatment. The electromotor force (EMF) corresponds to an electrochemical measuring chain of the following type:

Zn/M(2)//metal (A)/M(1)

where M(1) denotes the agent (1) containing cations and/or compounds of the metal (A) and where M(2) denotes the agent (2), which differs from M(1) only in that it does not contain any cations and/or compounds of the metal (A).

For the inventive method, it is advantageous if the redox potential $E_{redox}$ of the cations and/or compounds of the metal (A) in the aqueous agent (1) is at least +50 mV, preferably at least +100 mV and especially preferably at least +300 mV but at most +800 mV more anodic than the electric potential $E_{Zn}$ of the zinc surface in contact with the aqueous agent (2). If the EMF is less than +50 mV, sufficient metallization of the galvanized surface cannot be achieved within technically feasible contact times, so that in a subsequent passivating conversion treatment, the metal coating on the metal (A) is removed completely from the galvanized surface and the effect of the pretreatment is thus canceled. Conversely, if the EMF is too high, i.e., more than +800 mV, it may lead in a short period of time to complete and massive coverage of the galvanized surface with the metal (A), so that in a subsequent conversion treatment, the desired development of an inorganic corrosion-preventing and adhesion-promoting layer fails to occur or is at least hindered.

It has been found that the metallization is especially effective when the concentration of cations and/or compounds of the metal (A) amounts to at least 0.001M and preferably at least 0.01M, but not more than 0.2M, preferably not more than 0.1M.

The cations and/or compounds of the metal (A), which is deposited in a metallic state on the galvanized surface according to the pretreatment, are preferably selected from cations and/or compounds of iron, molybdenum, tungsten, cobalt, nickel, lead and/or tin, where iron in the form of iron(II) ions and/or iron(II) compounds is especially preferred, e.g., iron (II) sulfate. In comparison with the sulfate, the organic salts iron(II) lactate and/or iron(II) gluconate are especially preferred because of the lower corrosiveness of the anions as a source for iron(II) cations.

If various metals (A) are present side by side in the agent (1) according to the aforementioned preferred choice of metals (A), then the redox potential $E_{redox}$ of the metals (A) is to be determined individually and in the absence of the other metals (A) in the aqueous medium. A suitable agent (1) for the inventive method then contains at least one species of a metal (A) for which the condition with respect to the redox potential $E_{redox}$ is satisfied as defined above.

However, such agents (1) in which cations and/or compounds of the metal (A) are formed exclusively by one of the aforementioned elements are especially preferred.

In addition, such cations and/or compounds of metal (A) which satisfy the condition for the electromotor force (EMF) as described above as well as having a standard potential $E^0_{Me}$ of the metal (A) that is more cathodic than the normal potential $E^0_{H2}$ of the standard hydrogen electrode (SHE), preferably by more than 100 mV, especially preferably more cathodic by more than 200 mV than the normal potential $E^0_{H2}$, are especially preferred, where the standard potential $E^0_{Me}$ of the metal (A) is based on the reversible redox reaction $Me^0 \rightarrow Me^{n+} + n\ e^-$ in an aqueous solution of the metal cation $Me^{n+}$ with the activity 1 at 25° C.

If this second condition is not satisfied, then in a conversion treatment following the inventive method, passivation layers which are less homogeneous and have more defects are formed in a conversion treatment after the inventive method because of reduced pickling rates of the substrate surface. In the extreme case, the passivating conversion of the substrate surface pretreated in the inventive method is not performed at all in the subsequent process step. The same thing is also true of an organic coating, which is performed directly after the inventive pretreatment and is based on a self-deposition process initiated by pickling attack of the substrate (autophoretic dip coating, abbreviated: AC for "autodepositable coating").

In the inventive pretreatment process for increasing the deposition rate of cations and/or compounds of metal (A), i.e., metallization of the galvanized or alloy-galvanized surface, accelerators with a reducing effect are preferably added to the aqueous agent (1). Oxo acids of phosphorus or nitrogen as well as their salts may be considered as possible accelerators, where at least one phosphorus atom or nitrogen atom must be present in a medium oxidation level. Such accelerators include, for example, hyponitrous acid, hyponitric acid, nitrous acid, hypophosphoric acid, hypodiphosphonic acid, diphosphoric(III, V) acid, phosphonic acid, diphosphonic acid and especially preferably phosphinic acid and their salts.

In addition, accelerators with which those skilled in the art are familiar from the prior art in phosphating may also be used. In addition to their reducing properties, these also have depolarizing properties, i.e., they act as hydrogen scavengers and thus additionally promote metallization of the galvanized steel surface. These include hydrazine, hydroxylamine, nitroguanidine, N-methyl-morpholine N-oxide, glucoheptonate, ascorbic acid and reducing sugars.

The molar ratio of accelerator to the concentration of cations and/or compounds of metal (A) in the aqueous agent (1) is preferably no greater than 2:1, especially preferably no greater than 1:1, and is preferably is not lower than 1:5.

Optionally the aqueous agent (1) in the inventive method may additionally contain small amounts of copper(II) cations, which can also be deposited as metals on the galvanized surface simultaneously with the cations and/or compounds of the metal (A). However, it should be noted here that no massive, i.e., almost complete surface-covering cementation of copper occurs, because otherwise a subsequent conversion treatment is completely suppressed and/or paint adhesion is definitely exacerbated. Therefore, the aqueous agent (1) should additionally contain no more than 50 ppm, preferably no more than 10 ppm but at least 0.1 ppm copper(II) cations.

In addition, the aqueous agent (1) for the metallizing pretreatment may additionally contain surfactants capable of removing impurities from the metallic surface without inhibiting the surface itself for metallization by developing compact adsorbate layers. Preferably nonionic surfactants with an average HLB value of at least 8 and at most 14 may be used for this purpose.

For the case when cations and/or compounds of iron(II) are used for the inventive pretreatment process, the pH of the aqueous agent should be no less than 2 and no greater than 6, preferably no greater than 4, to prevent overpickling of the galvanized steel surface at a low pH, on the one hand, because this inhibits metallization of the surface and, on the other hand, to ensure the stability of the iron(II) anions in the treatment solution.

The treatment solution containing iron(II) may also contain chelating complexing agents with oxygen and/or nitrogen ligands for stabilization. Such a treatment solution is additionally suitable for increasing the EMF for metallization because iron(II) ions are not complexed as strongly by such ligands as are zinc(II) ions. The increase in EMF by the addition of complexing agents is significant for establishing a shorter duration of treatment and optimal iron coverage of the galvanized surface.

Chelating complexing agents may include specifically those selected from triethanolamine, diethanolamine, monoethanolamine, monoisopropanolamine, aminoethylethanolamine, 1-amino-2,3,4,5,6-pentahydroxyhexane, N-(hydroxyethyl)ethylenediaminetriacetic acid, ethylenediaminetetraacetic acid, diethylenetriaminepentaacetic acid, 1,2-diaminopropanetetraacetic acid, 1,3-diaminopropanetetraacetic acid, tartaric acid, lactic acid, mucic acid, gluconic acid and/or glucoheptonic acid as well as their salts and stereoisomers and also sorbitol, glucose and glucamine as well as their stereoisomers.

An especially effective formulation of the aqueous agent (1) with the complexing agents listed above is obtained with a molar ratio of chelating complexing agent to the concentration of cations and/or compounds of divalent iron of at least 1:5 but no more than 5:1, preferably no more than 2:1. Lower molar ratios than 1:5 cause only insignificant changes in the EMF for metallization. The situation is similar for molar ratios higher than 5:1, at which a large amount of free complexing agent is present, so the EMF for metallization remains almost unaffected and the process is not economical.

In addition, water-soluble and/or water-dispersible polymer complexing agents with oxygen and/or nitrogen ligands based on Mannich addition products of polyvinyl phenols with formaldehyde and aliphatic amino alcohols are used. Such polymers are described in detail in U.S. Pat. No. 5,298,289 and are herewith included as inventive complexing polymer compounds. Suitable in particular are water-soluble and/or water dispersible polymer complexing agents comprising x-(N—$R^1$—N—$R^2$-aminomethyl)-4-hydroxystyrene monomer units, where the substitution site x on the aromatic ring is x=2, 3, 5 or 6, $R^1$ is an alkyl group with no more than four carbon atoms, and $R^2$ is a substituent of the general empirical formula $H(CHOH)_mCH_2$— with a number m of hydroxymethylene groups of no more than 5 and no less than 3. Poly(5-vinyl-2-hydroxy-N-benzyl-N-glucamine) is especially preferred because of its pronounced complexing action.

By analogy with the complexing of iron(II) ions with low-molecular complexing agents, a molar ratio of chelating complexing agent, defined as the concentration of monomer units of the water-soluble and/or water-dispersible polymer compound to the concentration of cations and/or compounds of the metal (A) of no more than 5:1, preferably no more than 2:1, but at least 1:5 is especially effective for the polymeric compounds.

For the case when cations and/or compounds of tin are used in the oxidation stages +II and +IV for the inventive pretreatment method, the pH of the aqueous agent (1) is preferably no less than 4 and preferably no greater than 8, especially preferably no greater than 6.

For the inventive pretreatment method which constitutes a part of the process chain of surface treatment of galvanized and/or alloy-galvanized steel surfaces, the application methods conventionally used in strip steel production and strip steel refining are feasible. These include in particular dipping and spraying methods. However, the contact time or pretreatment time with the aqueous agent (1) should be at least 1 second but no more than 30 seconds, preferably no more than 10 seconds. Within this contact time, metallic coatings of the metal (A) with a layer coating of preferably at least 1 $mg/m^2$ but preferably no more than 100 $mg/m^2$ and especially preferably no more than 50 $mg/m^2$ are obtained with the inventive embodiment of the method. The metallic layer coating is defined in the sense of the present invention as the amount of the element (A) by weight relative to area on the galvanized or alloy-galvanized steel surface immediately after the inventive pretreatment.

The preferred contact times and layer coatings as well as the preferred application methods are likewise applicable to the inventive pretreatment of components joined from several metallic materials inasmuch as they have zinc surfaces at least in part.

The present inventive subject also includes the combinations of alloy-galvanized steel surfaces and aqueous agents (1) in which an alloy component of the galvanized steel surface is the same element (A) as the metal (A) in the form of its cations and/or compounds in the aqueous agent (1). For example, flame-galvanized Galvannealed® fine metal plate may also be pretreated with an agent (1) containing iron ions according to the present invention, with the consequence that slightly improved corrosion properties and delamination properties are obtained in the subsequent application of anticorrosion layers.

The inventive pretreatment method is tailored to the downstream process steps of surface treatment of galvanized and/or alloy-galvanized steel surfaces with regard to optimized corrosion protection and excellent adhesion of paint, especially at cut edges, surface defects and bimetal contacts. The present invention consequently also includes various after-treatment processes, i.e., conversion coatings and paint coatings, which yield the desired results with regard to corrosion protection when used in combination with the pretreatment described previously. FIG. 1 illustrates various process chains that are preferred in the sense of the present invention for anticorrosion coating of metallic surfaces in automotive production. These processes can be initiated at the steel production plant ("coil industry") and continued in the painting operation ("paint shop") at the automobile manufacturer's plant.

Therefore, in another aspect, the present invention relates to the production of a passivating conversion coating on the galvanized and/or alloy-galvanized steel surface pretreated by metallizing, with or without rinsing and/or drying steps in between (FIG. 1, method IIa).

A conversion solution containing chromium may be used for this purpose, but a chromium-free conversion solution is preferred. Preferred conversion solutions with which the metal surfaces pretreated according to the present invention can be treated before applying a permanent organic anticorrosion coating are disclosed in DE 199 23 084 A and the literature cited therein. According to this teaching, a chromium-free aqueous conversion agent may also contain the following as additional active ingredients in addition to hexafluoro anions of Ti, Si and/or Zr: phosphoric acid, one or more compounds of Co, Ni, V, Fe, Mn, Mo or W, a water-soluble or water-dispersible film-forming organic polymer or copolymer and organophosphonic acids with complexing properties. A detailed list of organic film-forming polymers, which may be used in the aforementioned conversion solutions, is given on page 4 of this document, lines 17 to 39.

Following that, this document discloses a very thorough list of complexing organophosphonic acids as possible additional components of the conversion solutions. Specific examples of these components can be found in DE 199 23 084 A cited above.

In addition, water-soluble and/or water-dispersible polymer complexing agent with oxygen and/or nitrogen ligands based on Mannich addition products of polyvinyl phenols with formaldehyde and aliphatic amino alcohols may also be present. Such polymers are disclosed in U.S. Pat. No. 5,298,289.

The process parameters for a conversion treatment in the sense of the present invention such as treatment temperature, treatment duration and contact time, are to be selected to produce a conversion layer containing per square meter of surface area at least 0.05 mmol, preferably at least 0.2 mmol, but no more than 3.5 mmol, preferably no more than 2.0 mmol and especially preferably no more than 1.0 mmol of the metal M, which is the essential component of the conversion solution. Examples of metals M include Cr(III), B, Si, Ti, Zr, Hf. The density of coverage of the zinc surface with the metal M may be determined an X-ray fluorescence method, for example.

In a special aspect of an inventive process (IIa) comprising a conversion treatment following the metallizing pretreatment the chromium-free conversion agent additionally contains copper ions. The molar ratio of metal atoms M selected from zirconium and/or titanium to copper atoms in such a conversion agent is preferably selected so that it creates a conversion layer containing at least 0.1 mmol, preferably at least 0.3 mmol, but no more than 2 mmol copper.

The present invention thus also relates to a method (IIa) comprising the following process steps including the metallizing pretreatment and the conversion treatment of the galvanized and/or alloy-galvanized steel surface:

i) optionally cleaning/degreasing the surface of the material, ii) metallizing pretreatment with an aqueous agent (1) according to the present invention, iii) optional rinsing and/or drying step, iv) chromium(VI)-free conversion treatment, in which a conversion layer is created, containing 0.05 to 3.5 mmol of the metal M per square meter of surface area, said metal M constituting the essential component of the conversion solution, whereby the metals M are selected from Cr(III), B, Si, Ti, Zr, Hf.

As an alternative to a method (IIa) in which the metallizing pretreatment is followed by a conversion treatment, forming a thin amorphous inorganic coating, a method (FIG. 1, IIb) in which the inventive metallization is followed by zinc phosphating, which forms a crystalline phosphate layer with a preferred layer weight of no less than 3 $g/m^2$ is used. According to the present invention, however, a method (IIa) is preferred because of the much lower process complexity and the definite improvement in corrosion protection of conversion layers on galvanized surfaces previously treated with metallization.

In addition, the metallizing pretreatment and the following conversion treatment are usually followed by additional methods steps for applying additional layers, in particular organic paints or paint systems (FIG. 1, method III-V).

Therefore, in another aspect, the present invention relates to a method (III), which expands the process chain (i-iv) of the method (II), whereby an organic coating agent (1) containing organic resin components dissolved or dispersed in an organic solvent or solvent mixture is applied, wherein the coating agent (1) contains at least the following organic resin components:

a) the present epoxy resin based on a bisphenol-epichlorohydrin polycondensation product as the hydroxyl group-containing polyether, b) blocked aliphatic polyisocyanate, c) unblocked aliphatic polyisocyanate, d) at least one reaction component selected from hydroxyl group-containing polyesters and hydroxyl group-containing poly(meth)acrylates.

Component a) is a fully reacted polycondensation product of epichorohydrin and a bisphenol which essentially has no more epoxy groups as reactive groups. The polymer is then in the form of a hydroxyl group-containing polyether capable of entering into crosslinking reactions with polyisocyanates, for example, by way of these hydroxyl groups.

The bisphenol component of this polymer may be selected from bisphenol A and bisphenol F, for example. The average molecular weight (according to the manufacturer's instructions, which can be determined by gel permeation chromatography, for example) is preferably in the range of 20,000 to 60,000, in particular in the range of 30,000 to 50,000. The OH number is preferably in the range of 170 to 210 and in particular in the range of 180 to 200. Polymers having a hydroxyl content, based on the ester resin, in the range of 5 to 7 wt % are especially preferred.

The aliphatic polyisocyanates b) and c) are preferably based on HDI, in particular on HDI trimer. The usual polyisocyanate blocking agents may be used as the blocking agent in the blocked aliphatic polyisocyanate b). Examples that can be mentioned include butanone oxime, dimethylpyrazole, malonic ester, diisopropylamine/malonic ester, diisopropylamine/triazole and ε-caprolactam. A combination of malonic ester and diisopropylamine as blocking agents is preferred for use here.

The blocked NCO group content of component g) is preferably in the range of 8 to 10 wt %, especially in the range of 8.5 to 9.5 wt %. The equivalent weight is preferably in the range of 350 to 600 g/mol, in particular in the range of 450 to 500 g/mol.

The unblocked aliphatic polyisocyanate c) preferably has an equivalent weight in the range of 200 to 250 g/mol and an NCO content in the range of 15 wt % to 23 wt %. For example, an aliphatic polyisocyanate having an equivalent weight in the range of 200 to 230 g/mol, in particular in the range of 210 to 220 g/mol and an NCO content in the range of 18 wt % to 22 wt %, preferably in the range of 19 wt % to 21 wt %, may be selected. Another suitable aliphatic polyisocyanate has an equivalent weight in the range of 220 g/mol to 250 g/mol, for example, in particular in the range of 230 to 240 g/mol, and an NCO content in the range of 15 wt % to 20 wt %, preferably in the range of 16.5 wt % to 19 wt %. Each of these aforementioned aliphatic polyisocyanates may constitute component c). However, component c) may also comprise a mixture of these two polyisocyanates. If a mixture of the two aforementioned polyisocyanates is used, then the quantity ratio of the polyisocyanate mentioned first to the polyisocyanate mentioned last is preferably in the range of 1:1 to 1:3 for component c).

Component d) is selected from hydroxyl group-containing polyesters and hydroxyl group-containing poly(meth)acrylates. For example, a hydroxyl group-containing poly(meth) acrylate with an acid number in the range of 3 to 12 mg KOH/g, in particular in the range of 4 to 9 mg KOH/g, may be used. The hydroxyl group content is preferably in the range of 1 to 5 wt % and in particular in the range of 2 to 4 wt %. The equivalent weight is preferably in the range of 500 to 700 g/mol, in particular in the range of 550 to 600 g/mol.

If a hydroxyl group-containing polyester is used as component d), then a branched polyester with an equivalent weight in the range of 200 to 300 g/mol, in particular in the range of 240 to 280 g/mol may be selected for this. In addition, a weakly branched polyester with an equivalent weight in the range of 300 to 500 g/mol, in particular in the range of 350 to 450 g/mol, is also suitable. These different types of polyester may constitute component d) either individually or as a mixture. A mixture of hydroxyl group-containing polyesters and hydroxyl group-containing poly(meth)acrylates may of course also be used as component d).

The coating agent (1) in the inventive method (III) thus contains a blocked aliphatic polyisocyanate b) as well as an unblocked aliphatic polyisocyanate c). The hydroxyl group-containing components a) and d) are available as potential reaction components for these two polyisocyanate types. Curing of the agent (2) yields a complex polymer network of polyurethanes due to the possible reaction of each of components a) and d) with each of components b) and c). In addition, in the case when hydroxyl group-containing poly(meth)acrylates are used as component d), other crosslinkages may occur via the double bonds of these components. If not all the double bonds of the poly(meth)acrylates are crosslinked in curing, then any double bonds present at the surface in particular may produce an improved adhesion to a paint applied subsequently if it also contains components having polymerizable double bonds. From this standpoint, it is preferable for component d) to consist at least partially of hydroxyl group-containing poly(meth)acrylates.

In curing of the coating agent (1) in the inventive method (III), the unblocked aliphatic polyisocyanate c) is expected to react first with one or both of components a) and d). If the hydroxyl groups of component d) are more reactive than those of component a), then a reaction of component c) with component d) preferably takes place first in curing.

On the other hand, the blocked aliphatic polyisocyanate b) reacts with one or both of components a) and d) only when the deblocking temperature has been reached. Then only the reactants of reaction partners a) and d) which have fewer reactive OH groups are available to form the polyurethane. For the resulting polyurethane network, this means, for example, that when the OH groups of component a) are less reactive than those of component d), two polyurethane networks are created from the reaction of components c) and d) on the one hand and components a) and b) on the other hand.

The coating agent (1) in the inventive method (III) contains the components a) and b) on the one hand and c) and d) on the other hand, preferably in the following relative weight ratios:

a):b)=1:0.8 to 1:1.3 c):d)=1:1.4 to 1:2.3

Components a) and d) on the one hand and b) and c) on the other hand are preferably present in the following relative weight ratios:

a):d)=1:2 to 1:6 and (preferably 1:3 to 1:5)

b):c)=1:0.5 to 1:5 (preferably 1:1 to 1:3).

Preferred absolute quantity ranges of the aforementioned four components a) through d) are given further below because they depend on the density of conductive pigments which are optionally present (FIG. 1, method IIIb). The coating agent (1) preferably contains a conductive pigment or a mixture of conductive pigments in addition to components a) through d). These pigments may have a relatively low density, like that of carbon black and graphite, or a relatively high density, like that of metallic iron. The absolute conductive pigment content of the coating agent (1) depends on its density, because the effect as the conductive pigment depends less on the amount of conductive pigment by weight than on the amount of conductive pigment by volume in the cured coating.

In general it is true that the coating agent (1) contains a conductive pigment, based on the total weight of the agent (0.8 to 8)ρ wt % of conductive pigment, where ρ is the density of the conductive pigment or the average density of the mixture of conductive pigments in $glcm^3$. The coating agent (1) preferably contains (2 to 6)ρ % of conductive pigment based on its total weight.

For example, this means that if the coating agent (1) contains only graphite with a density of 2.2 $g/cm^2$ as the conductive pigment, then it preferably contains at least 1.76 wt % graphite, in particular at least 4.4 wt %, and preferably no more than 17.6 wt %, in particular no more than 13.2 wt % graphite. If iron powder with a density of 7.9 $g/cm^2$ is used as the sole conductive pigment, then the coating agent (1) preferably contains at least 6.32 wt %, in particular at least 15.8 wt % and no more than 63.2 wt %, in particular no more than 47.4 wt %, based on its total weight. Accordingly, the amounts by weight are calculated as follows when exclusively $MoS_2$ with a density of 4.8 $g/cm^3$ is used as the conductive pigment, e.g., aluminum with a density of 2.7 $g/cm^3$ or zinc with a density of 7.1 $g/cm^3$.

However, a favorable combination of properties can be obtained if the coating agent (1) contains not only a single conductive pigment but also a mixture of at least two conductive pigments, which then preferably differ greatly in their density. For example, a mixture in which the first component of the mixture is a light conductive pigment such as carbon black, graphite or aluminum, and the second component of the mixture is a heavy conductive pigment such as zinc or iron may be used. In these cases, the average density of the mixture, which can be calculated from the amounts by weight of the components in the mixture and from their respective density, is used for the density ρ in the equation given above.

Accordingly, a special embodiment of a coating agent (1) in the method (IIIb) is characterized in that it contains a conductive pigment with a density of less than 3 $g/cm^3$ as well as a conductive pigment with a density of greater than 4 $g/cm^3$, where the total amount of conductive pigment, based on the total weight of the agent (2), is (0.8 to 8)ρ wt %, where ρ is the average density of the mixture of the conductive pigments in $g/cm^3$.

For example, the coating agent (1) may contain as the conductive pigment a mixture of carbon black or graphite on the one hand and iron powder on the other hand. The weight ratios of carbon black and/or graphite, on the one hand, and iron, on the other hand, may be in the range of 1:0.1 to 1:10, in particular in the range of 1:0.5 to 1:2.

The coating agent (1) may also contain aluminum flakes, graphite and/or carbon black as a light electrically conductive pigment, where the use of graphite and/or carbon black is preferred. Carbon black and graphite in particular not only produce an electric conductivity in the resulting coating but also contribute toward this layer having a desired low Mohs hardness of no more than 4 and being readily shapeable. The lubricant effect of graphite in particular contributes toward reduced wear on the shaping tools. This effect can be further promoted by additionally using pigments which have a lubricating effect, e.g. molybdenum sulfide. As an additional lubricant or shaping aid, the coating agent (1) may contain waxes and/or Teflon.

The electrically conductive pigment with a specific gravity of max. 3 $g/cm^3$ may be in the form of small beads or aggregates of such beads. It is preferable for the beads and/or aggregates of these beads to have a diameter of less than 2 μm. However, these electrically conductive pigments are preferably in the form of flakes with a thickness of preferably less than 2 μm.

The coating agent (1) in the inventive method (III) contains at least the resin components and solvents described above. The resin components a) to d) are usually in the form of solutions or dispersions in organic solvents in their commercial form. The coating agent (1) prepared from them then also contains these solvents.

This is desirable to establish a viscosity that makes it possible to apply the coating agent (1) to the substrate by the coil coating method despite the additional presence of the electrically conductive pigment such as graphite and optionally other pigments, such as in particular anticorrosion pigments. If necessary, a solvent may be added in addition. The chemical nature of the solvents is usually determined by the choice of raw materials contained in the corresponding solvent. For example, the solvent may comprise: cyclo-hexanone, diacetone alcohol, diethylene glycol monobutyl ether acetate, diethylene glycol, propylene glycol methyl ether, propylene n-butyl ether, methoxypropyl acetate, n-butyl acetate, xylene, glutaric acid dimethyl ester, adipic acid dimethyl ester and/or succinic acid dimethyl ester.

The preferred amount of solvent, on the one hand, and organic resin components, on the other hand, in the coating agent (1) depends on the amount of conductive pigment in wt % in the coating agent (1), when expressed in wt %. The higher the density of the conductive pigment, the greater is its preferred amount by weight in the total coating agent (1) and the lower are the amounts by weight of solvent and resin components. The preferred amounts by weight of solvent and resin components therefore depend on the density ρ of the conductive pigments used and/or the average density ρ of a mixture of conductive pigments.

In general, the coating agent (1) in the inventive method (III) preferably contains, based on the total weight of the coating agent (1), [(25 to 60)·fitting factor] wt %, preferably [(35 to 55)·fitting factor] wt % organic solvent and [(20 to 45)·fitting factor] wt %, preferably [(25 to 40)·fitting factor] wt % organic resin components, where the total of the amounts by wt % of the organic resin component and solvent is no more than [93·fitting factor] wt %, preferably no greater than [87·fitting factor] wt %, and the fitting factor [100−2.8ρ]:93.85 and ρ is the density of the conductive pigment or the average density of the mixture of conductive pigments in g/cm$^3$.

With regard to the individual resin component a), it is preferably true that the coating agent (1) contains, based on the total weight of the coating agent (1), [(2 to 8)·fitting factor] wt %, preferably [(3 to 5)·fitting factor] wt % of the resin component a), whereby the fitting factor is [100−2.8ρ]:93.85 and ρ is the density of the conductive pigment or the average density of the mixture of conductive pigments in g/cm$^3$. The preferred quantitative amounts of the resin components b) through d) in the coating agent (1) can be calculated from the quantitative amount of the resin component a) using the preferred quantity ratios of the individual resin components given above. For example, the amount of component b) in the total mass of the coating agent may amount to [(2 to 9)·fitting factor] wt %, preferably [(3 to 6)·fitting factor] wt %, the amount of resin components c) may be [(4 to 18)·fitting factor] wt %, preferably [(6 to 12)·fitting factor] wt %, and the amount of resin components d) may be [(7 to 30)·fitting factor] wt %, preferably [(10 to 20)·fitting factor] wt %. The "fitting factor" has the meaning given above.

In addition, it is preferably for the layer b) to additionally contain corrosion inhibitors and/or corrosion preventing pigments. Corrosion inhibitors or corrosion preventing pigments, which are known for this purpose in the prior art, may be used here. Examples which can be mentioned: magnesium oxide pigments, in particular in nanoscale form, finely divided and very finely divided barium sulfate or corrosion-preventing pigments, based on calcium silicate. The preferred amount by weight of the corrosion-preventing pigments in the total mass of the coating agent (1) in turn depends on the density of the corrosion-preventing pigments used. The coating agent (1) in the inventive method (III) preferably contains, based on the total mass of the coating agent, [(5 to 25)·fitting factor] wt %, in particular [(10 to 20)·fitting factor] wt % corrosion-preventing pigment, where the fitting factor is [100−2.8ρ]:93.85 and ρ is the density of the conductive pigment or the average density of the mixture of conductive pigments in g/cm$^3$.

The mechanical and chemical properties of the coating obtained after baking the coating agent (1) in the inventive method (III) may be further improved due to the fact that they additionally contain fillers. For example, these may be selected from silicic acids or silicon oxides (optionally hydrophobized), aluminum oxides (including basic aluminum oxide), titanium dioxide and barium sulfate. With regard to the preferred amounts thereof, it is true that the coating agent (1) contains [(0.1 to 3)·fitting factor] wt %, preferably [(0.4 to 2)·fitting factor] wt % filler, selected from silicic acids and/or silicon oxides, titanium dioxide and barium sulfate, where the fitting factor is [100−2.8ρ]:93.85 and ρ is the density of the conductive pigment or the average density of the mixture of conductive pigments in g/cm$^3$.

If lubricants or reshaping aids are additionally also used, then it holds that the coating agent contains, based on its total weight, lubricants or forming aids, preferably selected from waxes, molybdenum sulfide and Teflon, preferably in an amount of [(0.5 to 20)·fitting factor], in particular in an amount of [(1 to 10)·fitting factor] wt %, where the fitting factor is [100−2.8ρ]:93.85 and ρ is the density of the conductive pigment or the average density of the mixture of conductive pigments in g/cm$^3$.

The inventive method (III) which comprises application of organic paints, thus consists of the following process chain:

i) optionally cleaning/degreasing the surface of the material,
ii) metallizing pretreatment with an aqueous agent (1) according to the present invention,
iii) optional rinsing and/or drying step,
iv) chromium(VI)-free conversion treatment in which a conversion layer is created, containing 0.01 to 0.7 mmol of the metal M per square meter surface area, said metal M constituting the essential component of the conversion solution whereby the metals M are selected from Cr(III), B, Si, Ti, Zr, Hf,
v) optional rinsing and/or drying step,
vi) coating with a coating agent (1) according to the preceding description and curing at a substrate temperature in the range of 120 to 260° C., preferably in the range of 150 to 170° C.

All steps (i)-(vi) are preferably performed as strip treatment methods, whereby in step (vi) the liquid coating agent (1) is applied in an amount such that, after curing, the desired layer thickness obtained is in the range of 0.5 to 10 μm. Thus preferably the coating agent (1) is applied by the so-called coil coating method in which moving metal strips are coated continuously. The coating agent (1) can be applied by different methods, which are conventional in the prior art. For example, applicator rollers may be used to adjust the desired wet film thickness directly. As an alternative, the metal strip may be immersed in the coating agent (1) or sprayed with the coating agent (1), after which the desired wet film thickness is established with the help of squeeze rollers.

If metal strips that have been coated immediately previously with a metal layer, e.g., with zinc or zinc alloys, are coated electrolytically or by a melt-dip method, then it is not necessary to clean the metal surfaces before performing the metallizing pretreatment (ii). However, if the metal strips have already been stored and in particular treated with anti-corrosion oils, then a cleaning step (i) is necessary before performing step (ii).

After applying the liquid coating agent (1) in step (vi), the coated plate is heated to the required drying and/or crosslinking temperature for the organic coating. Heating of the coated substrate to the required substrate temperature ("peak metal temperature"=TMP) in the range of 120° C. to 260° C., preferably in the range of 150° C. to 170° C., may be performed in a continuous heated oven. However, the treatment agent may also be brought to the proper drying and/or crosslinking temperature by infrared radiation, in particular by near-infrared radiation.

In automotive manufacturing for the production of vehicle bodies, such precoated metal plates are cut to size and shaped accordingly. The assembled component and/or assembled rough body consequently has unprotected cut edges which require additional corrosion protection. Therefore, an additional corrosion-preventing treatment is performed in the so-called paint shop and ultimately a paint structure typical of an automobile is implemented.

Therefore, in another aspect, the present invention relates to a method (IV) which expands the process chain (i-vi) of the method (III), such that first a crystalline phosphate layer is deposited on the exposed metal surfaces, in particular on the cut edges, to then implement a final corrosion protection, in particular protection against corrosive delamination of the paint system at the cut edges, by means of dip coating. For the case when the initial coating in method (III) with an organic coating agent (1) leads to a conductive coating, the entire metallic component, including the phosphated cut edges and the surfaces initially coated in method (III), may be electro-dip coated (FIG. 1, method IVb). If the conductivity of the initial coating is insufficient, then only the phosphated cut edges are electro-dip coated, without achieving any further buildup of paint structure on the surfaces coated initially. The same thing also applies when the cut edges are not phosphated but are coated with a self-depositing dip coating (AC) (FIG. 1, method IVc). However, the present invention is characterized in that the zinc surfaces pretreated by metallizing according to the present invention are excellent in suppressing edge corrosion in particular. In an inventive process chain comprising electro-dip coating (KTL, ATL) in method (IV) and application of additional paint layers in method (V), the amount of dip coating deposited per square meter of the component consisting of zinc surfaces pretreated according to the present invention (FIG. 1, method I) and/or the amount of filler to be applied, which has the task mainly of protecting the plates of the automotive body from stone impact and to compensate for any irregularities in the metal surface, can definitely be reduced in the second coating (FIG. 1, method V) without resulting in a loss of performance with regard to corrosion prevention and paint adhesion.

In another aspect, the present invention relates to the galvanized and/or alloy-galvanized steel surface as well as the metallic component, which consists at least partially of a zinc surface pretreated by metallizing according to the inventive method with the aqueous agent (1) or coated after this pretreatment with additional passivating conversion layers and/or paints, e.g., according to the inventive methods (II-IV).

A steel surface or component pretreated in this way is used in vehicle body production in automotive manufacturing, in shipbuilding, in the construction industry and for the production of white goods.

EXAMPLES

Figure 2:
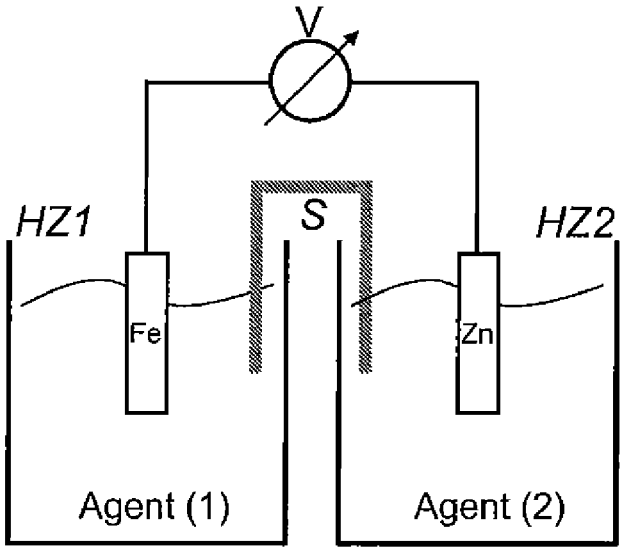
FIG. 2 shows a schematic diagram of an electrochemical measuring chain for determining the electromotive force for the inventive metallization of a zinc surface with iron by means of external currentless measurement of the potential difference (V) of galvanic half-cells (HZ1, HZ2) connected to a salt bridge (S).

An electrochemical measuring chain for determining the electromotor force (EMF) for the inventive metallizing pretreatment is shown in FIG. 2. The measuring chain consists of two galvanic half-cells, where one half-cell contains the agent (1) having cations and/or compounds of a metal (A), while the other half-cell contains the agent (2) differing from the agent (1) in that it does not have any cations and/or compounds of an agent (A), Both half-cells are connected to a salt bridge, and the voltage difference between a metal electrode of the metal (A) in the agent (1) and a zinc electrode in the agent (2) is measured in a currentless process. A positive EMF means that the redox potential $E_{redox}$ of the cations and/or compounds of the metal (A) in the agent (1) is more anodic than the electrode potential $E_{Zn}$. In the following Table 1, the EMF, measured according to a measuring chain like that in FIG. 2 for an agent (1) containing iron(II) cations suitable for the inventive metallizing pretreatment is documented.

TABLE 1

EMF of various agents (1) assembled from iron(II) sulfate, hypophosphoric acid and lactic acid, measured with a measuring chain according to FIG. 2

| Cations of metal (A) in agent (1)* | T in ° C. | EMF in V |
|---|---|---|
| 0.01 m/L Fe(II)# | 20 | 0.445 |
| 0.1 mol/L Fe(II)# | 20 | 0.462 |
| 0.2 mol/L Fe(II)# | 20 | 0.468 |

*Composition of the agent (1): 0.15 mol/L $H_3PO_2$ 0.033 mol/L lactic acid
#Fe(II) as $FeSO_4 \cdot 7H_2O$ For an exemplary description of the improvement in the protection of cut edges after performing the metallizing pretreatment according to the invention ("ironizing") of galvanized strip steel, the process chain of the inventive method (III) is performed below on electrolytically galvanized steel plates (DC04, ZE 75/75, automotive grade). The galvanized steel plates coated and treated in this way were clamped at the cut edges in a beechwood block and stored for ten weeks in constantly moist environment in a VDA alternating climate test (621-415).

Inventive Examples B1-B3

The inventive method (III) is broken down in detail below, including the wording used:

(i) the electrolytically galvanized steel plate (ZE) is degreased with alkaline cleaning agents (e.g., Ridoline® C 72, Ridoline® 1340; dip and spray cleaning products by the present applicant);

(ii) the metallizing pretreatment ("ironizing") is performed at a temperature of the aqueous medium (1) of 50° C. at a pH of 2.5 in the immersion method with a contact time of t=2 sec (B1) and/or t=5 sec (B2), where the agent (1) has the following composition:
B1: 27.8 g/L $FeSO_4.7H_2O$
B2: 13.9 g/L $FeSO_4.7H_2O$
9.9 g/L $H_3PO_2$
3.0 g/L lactic acid (iii) rinsing step by immersing the pretreated plate in tap water;

(iv) a commercial pretreatment solution based on phosphoric acid, manganese phosphate, $H_2TiF_6$ and aminomethyl-substituted polyvinyl phenol (Granodine® 1455T from the present applicant) is applied to the metal surface using a Chemcoater (roller application method). Drying is then performed at 80° C. and the resulting layer coating of titanium is between 10 and 15 mg/m$^2$, determined by X-ray fluorescence analysis;

(v) rinsing step by immersing the pretreated plate in tap water;

(vi) a commercial coating agent (1) containing graphite as the conductive pigment, based on the composition given in the example part of German Patent Application DE 102007001654.0 (see Example 1 there) is applied to the pretreated plates using a Chemcoater and cured by heating in a drying cabinet at a substrate temperature of 160° C. Application of the coating agent yields a dry film layer thicknesses of 1.8 μm.

The layer coating of iron on the electrolytically galvanized steel surface may be dissolved in a wet chemical process in 10 wt % hydrochloric acid immediately after the process step (ii) and then determined by means of atomic absorption spectroscopy (AAS) or, as an alternative, in comparative experiments on pure zinc substrates (99.9% Zn) by means of X-ray fluorescence analysis (RFA). In the metallizing pretreatment according to B1 in process step (ii), it amounts to approx. 20 $mg/m^2$ Fe.

Comparative Example V1

The inventive method (III) is modified in such a way that the process step (ii), i.e., the metallizing pretreatment, is omitted.

Comparative Example V2

The inventive method (III) is modified in such a way that instead of the process step (ii), an alkaline passivating pretreatment with the commercial product of the present applicant (Granodine® 1303) is performed according to the formulation based on iron(III) nitrate described in Unexamined German Patent Application DE 19733972 (see Table 1, Example 1 there).

Comparative Example V3

After degreasing with an alkaline cleaning agent system from the present applicant (Ridoline® 1565/Ridosol® 1237), the plate is activated in a commercial activating solution (Fixodine® 9112) and passivated in a triple-chamber phosphating bath from the present applicant (Granodine® 958A) before being coated with the paint system by analogy with process step (vi).

Following the process chain according to method (III), all the plates are cut to size to create the cut edges and again are subjected to a phosphating as described in Comparative Example V3.

A cathodic dip coat (EV 2005, PPG Industries) with a layer thickness of 18-20 μm is subsequently deposited on all plates pretreated and coated in this way and then baked in a circulating oven for 20 minutes at 175° C. Thus, on the whole, a process chain beginning with the anticorrosion pretreatment of the zinc substrate by the steel manufacturer (FIG. 1, methods II and IIb) and ending with the deposition of the dip coat in the paint shop for vehicle body production (FIG. 1, method IVb) is readjusted experimentally.

Table 2 shows the results with regard to the corrosive delamination of the paint coating at the cut edge after ten weeks of the alternating climate test. Since the delamination of the paint coating advances to different extents at different locations on the cut edge, Table 2 shows the maximum delamination of the coating in millimeters for the corresponding coating system.

TABLE 2

Delamination of the paint coating at the cut edges according to the VDA alternating climate test (621-415)

| Examples | Delamination of coating at the cut edge/mm |
|---|---|
| V1 | 7.9 |
| V2 | 6.5 |
| V3 | 9.4 |
| B1 | 1.5 |

On the basis of the results in the VDA alternating climate test, the superior corrosion protection of the inventive metallizing pretreatment ("ironizing") on the cut edge in comparison with the conventional treatment methods becomes apparent. The alkaline passivation by means of iron(III)-containing solutions described in the prior art offers improved protection of cut edges in comparison with phosphated plates (V3) and plates without any passivating pretreatment (V1), but that method is far less effective than the metallic pretreatment (B1) according to the present invention.

Figure 3:
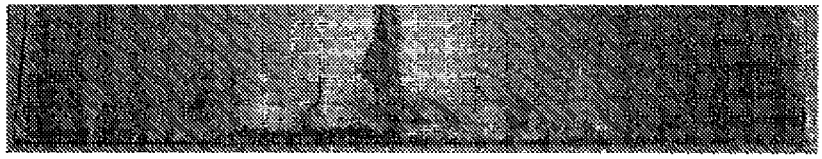
FIG. 3 shows photographs of infiltration of a paint coating at the cut edge after continuous moist storage of the galvanized steel plates (ZE 75/75) treated according to a typical process chain IIa→IIIa→IVb (see FIG. 1) and stored in a beechwood block according to the VDA alternating climate test (621-415) for 20 cycles. "*" indicates a panel from a comparative experiment without the inventive metallizing pretreatment but with phosphating (Granodine® 958) and electro-dip coating (EV 2005®) corresponding to a conventional process chain IIb→IVa (see FIG. 1). Reduced edge corrosion and delamination of the paint system at the cut edge of metallized pretreated galvanized or alloy-galvanized steel surfaces according to the invention (FIG. 3 panels B1, B2) in comparison with a zinc surface with comparative treatments (FIG. 3 panels V1, V2, V3) for a coating system according to the process chain IIa→IIIa→IVb (see FIG. 1) is seen.
Figure 3:
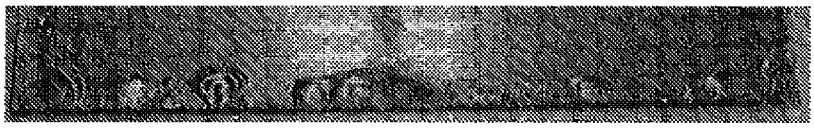
Figure 3:
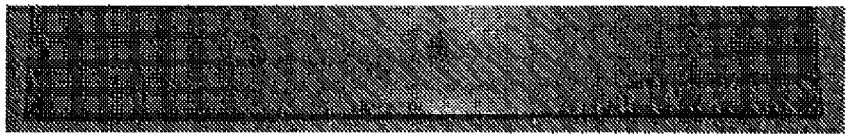
Figure 3:
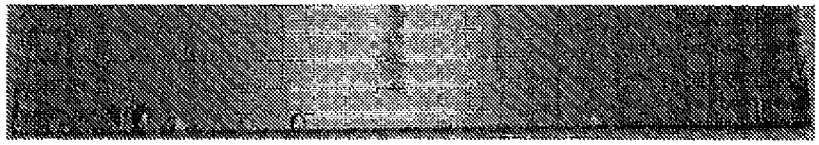
Figure 3:
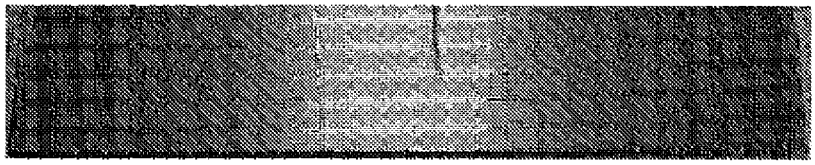

The excellent result with regard to minimizing edge corrosion and delamination of the paint system at the cut edge with the inventive pretreatment (B1, B2) in comparison with a zinc surface (V2) with an alkaline pretreatment for a coating system according to the process chain IIa→IIIa→IVb (see FIG. 1) is illustrated in FIG. 3. In addition, it is found that even with a reduction in the iron(II) concentration (B2) in the inventive pretreatment, a more extensive suppression of delamination of the paint coating at the cut edge can be achieved when the contact time with the agent (1) is increased from 2 sec (B1) to 5 sec (B2) as in the inventive examples. Likewise, on the basis of FIG. 3, the negative effect of the omission of the inventive pretreatment (V1) within such a process chain as that for the inventive examples (B1, B2) is clear. Conventionally treated galvanized surfaces that were phosphated without the inventive pretreatment and then electro-dip coated (V3) also show definite blistering and delamination of the paint coating at the cut edges.

Figure 4:
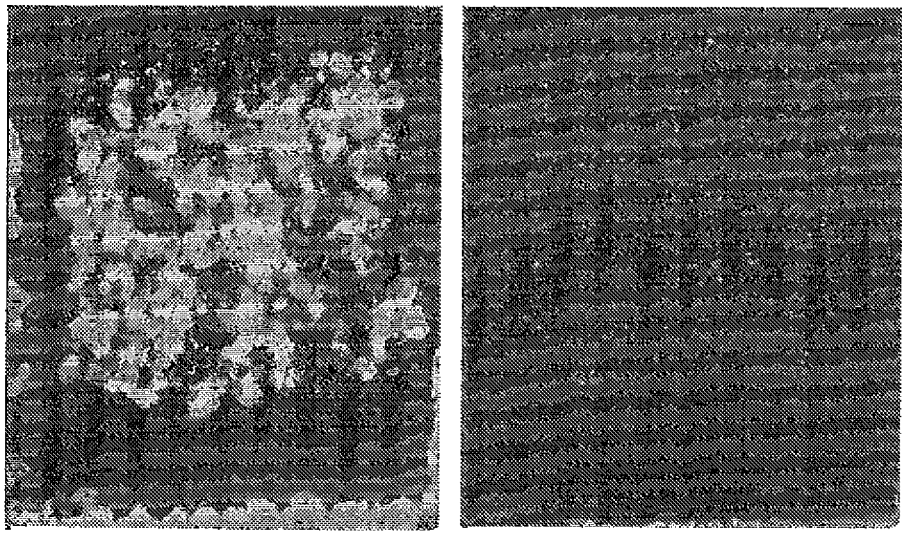
FIG. 4 shows photographs of panels that were tested for stone impact according to DIN 55996-1 after 11 cycles of corrosion storage according to VDA 621-415 of the galvanized steel plates (ZE 75/75) treated according to a typical process chain (see FIG. 1, method IVb). To better differentiate between the free metal surface and the coated substrate, the plates were dipped in an aqueous solution of copper sulfate and the free metal surface was thereby copper-plated. Reduced damage from the stone impact test by means of the metallizing pretreatment ("ironizing") according to the invention (FIG. 4 panel B1) as compared to a comparative treatment (FIG. 4 panel V2) is shown.

An improvement in the results in the stone impact test by means of the metallizing pretreatment ("ironizing") is also apparent. The photographs in FIG. 4 show that, first of all, the adhesion of paint is apparently increased by the inventive pretreatment and secondly, there is hardly any discernible corrosive delamination of the paint coating.

Figure 5:
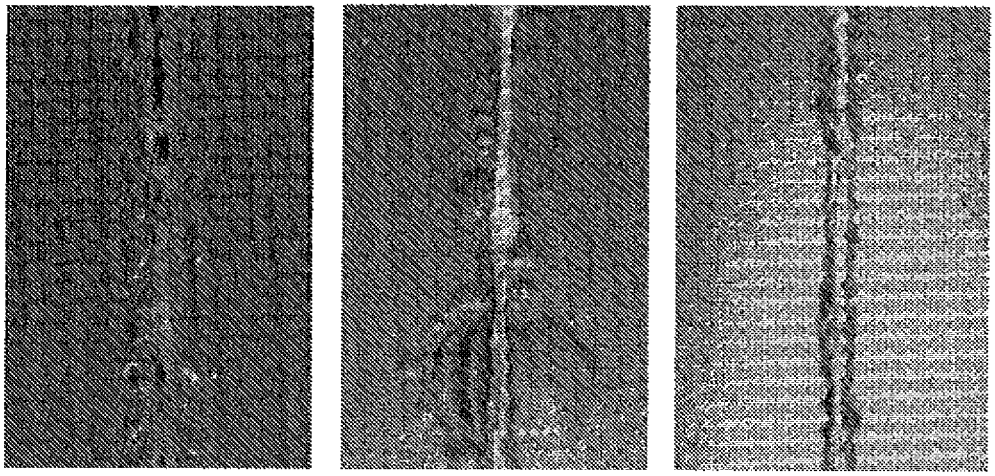
FIG. 5 shows photographs of infiltration of paint coating at the scratch after storage for 11 cycles according to the VDA alternating climate test (621-415) on galvanized steel plates with various coatings (DC04, ZE 75/75) according to FIG. 1. Reduced corrosive delamination of a paint coating of metallized pretreated galvanized or alloy-galvanized steel surfaces according to the invention (FIG. 5 panel B1) pretreated according to the present invention and conversion treated and coated according to the process chain IIa→IIIa→IVb (see FIG. 1) in comparison with galvanized steel surfaces receiving comparative treatments (FIG. 5 panels V1 and V3) is seen.

The corrosive delamination of the paint coating at the scratch also proves the advantages of the inventive pretreatment ("ironizing" of the zinc surface), as is apparent from FIG. 5. Thus, a lower corrosive delamination of the paint coating is achieved in comparison with galvanized steel surfaces that have only been phosphated and dip-coated (V3) on the zinc surfaces (B1) pretreated according to the present invention and conversion treated and coated according to the process chain IIa→IIIa→IVb (see FIG. 1). The omission of the inventive pretreatment according to process step I (see FIG. 1) in a treatment method according to Example V2 leads to especially negative properties of the total coating at a scratch with regard to corrosive delamination of the paint coating.

In an alternative process chain in which a zirconium-based conversion treatment (FIG. 1, method IIa) is performed following the inventive pretreatment (FIG. 1, method I) and immediately thereafter, i.e., without applying and curing an organic coating agent (FIG. 1, method IIIa or IIIb), an electro-dip coating is deposited (FIG. 1, method IVa), it is also possible to show that corrosive delamination of the paint coating at a scratch is significantly minimized.

The galvanized steel plates (ZE, Z) are first cleaned and degreased according to the procedure described above, to then be pretreated by metallizing with an agent having the composition according to Example B1 for 2 seconds at a certain pH and a temperature of 50° C. after an intermediate rinsing with the ionized water ($K<1\ \mu Scm^{-1}$) (FIG. 1, method I). The conversion treatment performed after an intermediate rinsing with deionized water was performed in an acidic aqueous composition of 750 ppm Zr as $H_2ZrF_6$
20 ppm Cu as $Cu(NO_3)_2$
10 ppm Si as $SiO_2$
200 ppm Zn as $Zn9(NO_3)_2$ at a pH of 4 and a contact time of 90 sec at a temperature of 20° C. (FIG. 1, method IIa). After another rinsing step with deionized water, a cathodic dip coating (CathoGuard 500) was applied in a layer thickness of 20 μm, and the plates coated in this way were cured for 30 minutes at 180° C. in a circulating air oven before scratching the surface in the middle of the plate down to the steel substrate for several centimeters using a scratch testing tool according to Clemen. Table 3 shows the resulting corrosion values (measured beneath the paint) on the scratch according to the VDA alternating climate test as determined in this experiment.

TABLE 3

Infiltration of paint coating at a scratch on steel plates (Gardobond ® test plates, Chemetall) coated according to the process chain I → IIa → IVa (see FIG. 1) after ten cycles in the VDA alternating climate test (621-415)

| Example | pH# of the agent (1) | Substrate | U/2 in mm |
|---|---|---|---|
| V4* | — | Z | 4.1 |
| | | ZE | 3.5 |
| B1 | 2.7 | Z | 1.6 |
| | | ZE | 1.1 |
| | 3.5 | Z | 1.8 |
| | | ZE | 1.8 |

Figure 6:
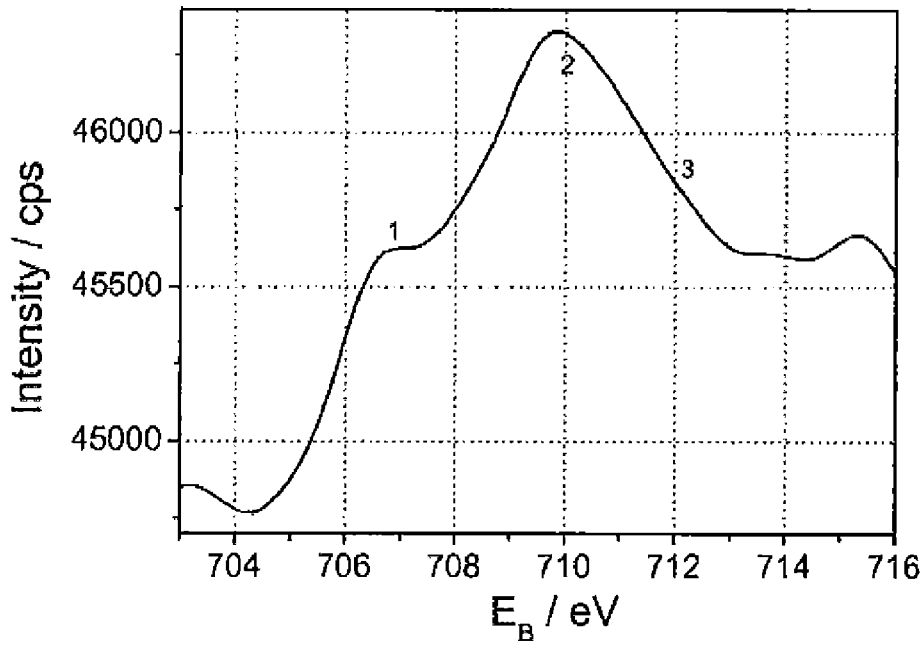
FIG. 6 shows X-ray photoelectronic (XPS) detail spectra of $Fe(2p^{3/2})$ according to Comparative Example V2 immediately after process step (ii).
Figure 7:
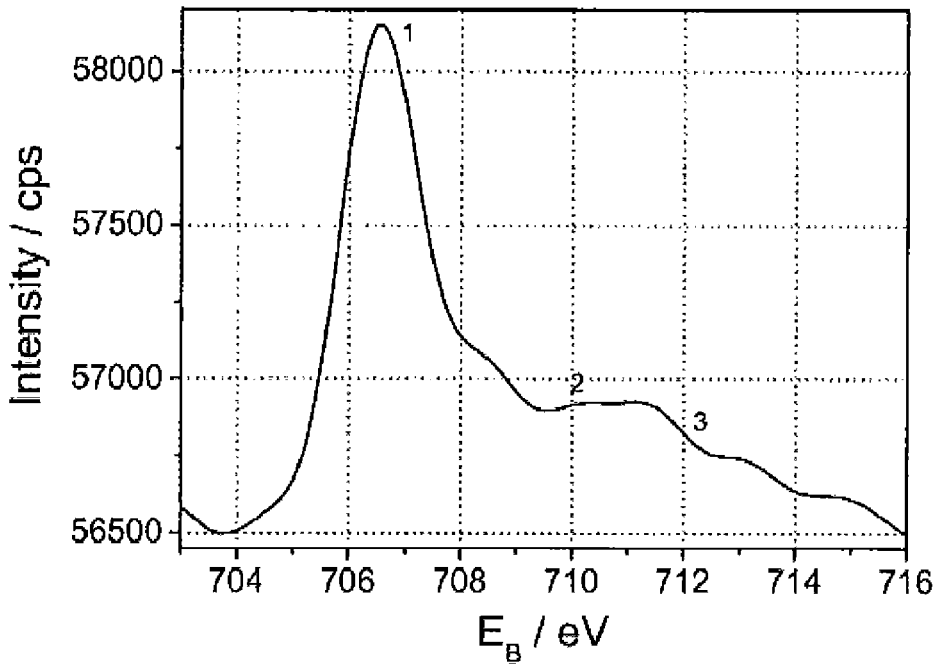
FIG. 7 shows $Fe(2p^{3/2})$ XP detail spectrum according to inventive Example B1 immediately after process step (ii).

*No pretreatment
#pH value adjusted with ammonia solution or sulfuric acid
Z Melt dip galvanized steel
ZE Electrolytically galvanized steel FIGS. 6 and 7 again prove on the basis of the X-ray photoelectronic (XPS) detail spectra of Fe($2p^{3/2}$) that the thin iron coating applied in the inventive method has a metallic character, and definitely more than 50 at % of the iron atoms are present in metallic form. This is qualitatively discernible by the definite shift in the total peak intensity in favor of peak 1 (FIG. 7) at lower bonding energies in comparison with the intensity of this individual peak in alkaline passivation (V2). Quantification is performed as a standard via a numerical fitting process of the XP detail spectrum by means of Gaussian individual peaks, by which it is possible to determine the individual peak area. Table 4 shows quantitatively the chemical bond state of the iron layer immediately after the respective exemplary pretreatments (V2) or inventive pretreatments (B1).

TABLE 4

Percentage amounts of different bond states of iron on the galvanized steel surfaces, determined by X-ray photoelectron spectroscopy (XPS)

| Example | Fe metallic/at % | Fe oxidic/at % |
|---|---|---|
| V2 | 28 | 72 |
| B1 | 63 | 37 |

What is claimed is:

1. A method for metallizing pretreatment of galvanized or alloy-galvanized steel surfaces, comprising:

I. contacting a galvanized or alloy-galvanized steel surface with an aqueous agent (1), having a pH no greater than 9, thereby producing a metallized pretreated galvanized or alloy-galvanized steel surface, said aqueous agent (1) comprising:

(a) cations and/or compounds of a metal (A), said metal selected from the group consisting of iron, molybdenum, tungsten, cobalt, nickel, lead, tin and mixtures thereof in a concentration of at least 0.001M, and (b) accelerators selected from the group consisting of oxo acids of phosphorus, oxo acids of nitrogen, salts of oxo acids of phosphorus and salts of oxo acids of nitrogen, wherein at least one phosphorus atom or nitrogen atom is present in a medium oxidation stage of said accelerators such that said accelerators have a reducing effect, the aqueous agent (1) having a molar ratio of accelerators to the concentration of cations and/or compounds of metal (A) of at least 1:5; and the cations and/or compounds of metal (A) having a redox potential $E_{redox}$ measured on a metal electrode of the metal (A) at a predetermined process temperature and concentration of cations and/or compounds of the metal (A) in the aqueous agent (1); the galvanized or alloy-galvanized steel surface having an electrode potential $E_{Zn}$ when in contact with an aqueous agent (2) differing from the agent (1) only in that the aqueous agent (2) does not contain any cations and/or compounds of the metal (A), wherein the redox potential $E_{redox}$ is more anodic than the electrode potential $E_{Zn}$;

whereby metallic coatings are deposited on the galvanized or alloy-galvanized steel surface said metallic coatings comprising at least 50 atomic % of the metal (A) present in a metallic state.

2. The method according to claim 1, wherein the redox potential $E_{redox}$ of the cations and/or compounds of the metal (A) in the aqueous agent (1) is more anodic than the electrode potential $E_{Zn}$ of the galvanized or alloy-galvanized steel surface in contact with the aqueous agent (2) by at least +50 mV but at most +800 mV.

3. The method according to claim 1, wherein the concentration of cations and/or compounds of the metal (A) is at least 0.01M but not more 0.2M.

4. The method according to claim 1, wherein iron(II) ions and/or iron(II) compounds are used as the cations and/or compounds of the metal (A).

5. The method according to claim 4, wherein the pH of the aqueous agent (1) is no less than 2 and no greater than 6.

6. The method according to claim 4, wherein the aqueous agent (1) additionally contains chelating complexing agents having oxygen and/or nitrogen ligands.

7. The method according to claim 6, wherein the chelating complexing agents are selected from triethanolamine, diethanolamine, mono-ethanolamine, monoisopropanolamine, aminoethylethanolamine, 1-amino-2,3,4,5,6-pentahydroxyhexane, N-(hydroxyethyl)ethylenediamine-triacetic acid, ethylenediaminetetraacetic acid, diethylene-triaminepentaacetic acid, 1,2-diaminopropanetetraacetic acid, 1,3-diaminopropanetetraacetic acid, tartaric acid, lactic acid, mucic acid, gluconic acid and/or glucoheptonic acid, salts of said acids, sorbitol, glucose and glucamine and stereoisomers thereof.

8. The method according to claim 7, wherein the aqueous agent (1) has a molar ratio of chelating complexing agents to the concentration of cations and/or compounds of the metal (A) that is no greater than 5:1 but is at least 1:5.

9. The method according to claim 6, wherein water-soluble and/or water-dispersible polymer compounds, comprising x-(N—$R^1$—N—$R^2$-aminomethyl)-4-hydroxystyrene monomer units are used as the chelating complexing agents, wherein x=2, 3, 5 or 6; $R^1$ is an alkyl group with no more than four carbon atoms, and $R^2$ is a substituent of general empirical formula $H(CHOH)_mCH_2$— with a number m of hydroxymethylene groups of no more than 5 and no less than 3.

10. The method according to claim 9, wherein the aqueous agent (1) has a molar ratio of chelating complexing agents, defined as concentration of monomer units of the water-soluble and/or water-dispersible polymer compound to the concentration of cations and/or compounds of the metal (A), is no greater than 5:1 but at least 1:5.

11. The method according to claim 1, wherein cations and/or compounds of tin in the oxidation stages +II and/or +IV are used as cations and/or compounds of the metal (A).

12. The method according to claim 1, wherein the pH of the aqueous agent is no less than 4 and no more than 8.

13. The method according to claim 1, wherein the aqueous agent (1) additionally contains accelerators selected from hydrazine, hydroxylamine, nitroguanidine, N-methylmorpholine N-oxide, glucoheptonate, ascorbic acid and reducing sugars.

14. The method according to claim 1, wherein the aqueous agent (1) additionally contains no more than 50 ppm but at least 0.1 ppm copper(II) cations.

15. The method according to claim 1, wherein the galvanized or alloy-galvanized steel surface is contacted with the aqueous agent for at least 1 second, but no more than 30 seconds.

16. The method according to claim 15, wherein after contacting the galvanized or alloy-galvanized steel surface with the aqueous agent (1), a metallic coating with metal (A) in a layer coating of at least 1 $mg/m^2$ but no more than 100 $mg/m^2$ is obtained.

17. The method according to claim 1, wherein after contacting the galvanized or alloy-galvanized steel surface with the aqueous agent (1), with or without an intermediate rinsing and/or drying step, a passivating conversion treatment of the metallized pretreated galvanized or alloy-galvanized steel surface is performed by contacting the metallized pretreated galvanized or alloy-galvanized steel surface with a composition different from the aqueous agent (1).

18. The method according to claim 17, further comprising additional process steps for applying additional layers comprising paint or paint systems.

19. The method according to claim 17, wherein the passivating conversion treatment comprises a chromium(VI)-free conversion treatment, in which a conversion layer is created, containing 0.05 to 3.5 mmol of a metal M per square meter of surface area, said metal M constituting an component of the composition different from the aqueous agent (1), whereby the metal M is selected from Cr(III), B, Si, Ti, Zr, Hf and combinations thereof.

20. The method according to claim 1, further comprising a step of coating the metallized pretreated galvanized or alloy-galvanized steel surface with an autodepositable coating based on a self-deposition process.

21. A method for treating galvanized or alloy-galvanized steel or joined metal parts, at least partially having zinc surfaces, comprising steps of:

I. depositing a metal coating, comprising at least 50 atomic percent of iron in a metallic state, on at least zinc-containing surfaces of a galvanized or alloy-galvanized steel substrate or joined metal parts, by contact, for 1 to 30 seconds, with an aqueous agent (1), having a pH of no less than 2 and no greater than 6, comprising:

(a) cations and/or compounds of iron in a concentration of at least 0.001M, and (b) accelerators selected from the group consisting of oxo acids of phosphorus, oxo acids of nitrogen, salts of oxo acids of phosphorus and salts of oxo acids of nitrogen, wherein at least one phosphorus atom or nitrogen atom is present in a medium oxidation stage of said accelerators such that said accelerators have a reducing effect, the aqueous agent (1) having a molar ratio of accelerators to the concentration of cations and/or compounds of iron of at least 1:5; and the cations and/or compounds of iron having a redox potential $E_{redox}$ measured on a metal electrode of the iron at a predetermined process temperature and concentration of cations and/or compounds of the iron in the aqueous agent (1); the galvanized or alloy-galvanized steel surface having an electrode potential $E_{Zn}$ when in contact with an aqueous agent (2) differing from the agent (1) only in that the aqueous agent (2) does not contain any cations and/or compounds of the iron, wherein the redox potential $E_{redox}$ is more anodic than the electrode potential $E_{Zn}$; thereby producing a metallized surface;

II. contacting the metallized surface with:

(a) a chromium(VI)-free conversion treatment, in which a conversion layer is created, containing 0.05 to 3.5 mmol of a metal M per square meter of surface area, said metal M being selected from Cr(III), B, Si, Ti, Zr, Hf; or (b) a zinc phosphating conversion treatment, which forms a crystalline phosphate conversion layer; and III.optionally, after step II, coating the conversion layer with a coating agent (1) comprising at least components:

a) epoxy resin based on a bisphenol-epichlorohydrin polycondensation product as the hydroxyl group-containing polyether, b) blocked aliphatic polyisocyanate, c) unblocked aliphatic polyisocyanate, d) at least one reaction component selected from hydroxyl group-containing polyesters and hydroxyl group-containing poly(meth)acrylates;

and curing at a substrate temperature in the range of 120 to 260° C.

22. The method according to claim 21, wherein the redox potential $E_{redox}$ of the cations and/or compounds of the metal (A) in the aqueous agent (1) is more anodic than the electrode potential $E_{zn}$ of the galvanized or alloy-galvanized steel surface in contact with the aqueous agent (2) by at least +50 mV but at most +800 mV.

23. The method according to claim 21, wherein the concentration of cations and/or compounds of (a) is at least 0.01M but not more 0.2M.

24. The method according to claim 21, wherein the aqueous agent (1) additionally contains chelating complexing agents having oxygen and/or nitrogen ligands.

25. The method according to claim 24, wherein the aqueous agent (1) has a molar ratio of chelating complexing agents to the concentration of cations and/or compounds of (a) that is no greater than 5:1 but is at least 1:5.

26. The method according to claim 24, wherein water-soluble and/or water-dispersible polymer compounds, comprising x-(N-$R^1$-N-$R^2$-aminomethyl)-4-hydroxystyrene monomer units are used as the chelating complexing agents, wherein x =2, 3, 5 or 6; $R^1$ is an alkyl group with no more than four carbon atoms, and $R^2$ is a substituent of general empirical formula $H(CHOH)_mCH_2$- with a number m of hydroxymethylene groups of no more than 5 and no less than 3.

27. The method according to claim 26, wherein the aqueous agent (1) has a molar ratio of chelating complexing agents, defined as concentration of monomer units of the water-soluble and/or water-dispersible polymer compound to the concentration of cations and/or compounds of (a), is no greater than 5:1 but at least 1:5.

28. The method according to claim 21, wherein the pH of the aqueous agent is no less than 4 and no more than 8.

29. The method according to claim 21, wherein the aqueous agent (1) additionally contains accelerators selected from hydrazine, hydroxylamine, nitroguanidine, N-methylmorpholine N-oxide, glucoheptonate, ascorbic acid and reducing sugars.

30. The method according to claim 21, wherein the aqueous agent (1) additionally contains no more than 50 ppm but at least 0.1 ppm copper(II) cations.

31. The method according to claim 21, wherein after contacting the galvanized or alloy-galvanized steel surface with the aqueous agent (1), a metallic coating with metal (A) in a layer coating of at least 1 $mg/m^2$ but no more than 100 $mg/m^2$ is obtained.

32. A method for treating galvanized or alloy-galvanized steel or joined metal parts, at least partially having zinc surfaces, comprising:

I. depositing a metal coating on at least zinc-containing surfaces of a galvanized or alloy-galvanized steel substrate or joined metal parts, by contact, for 1 to 30 seconds, with an aqueous agent (1), having a pH of no less than 2 and no greater than 9, consisting of:

(a) cations and/or compounds of a metal (A), said metal selected from the group consisting of iron, molybdenum, tungsten, cobalt, nickel, lead, tin and mixtures thereof in a concentration of at least 0.001M, and (b) accelerators selected from the group consisting of hydrazine, hydroxylamine, nitroguanidine, N-methylmorpholine N-oxide, glucoheptonate, ascorbic acid, reducing sugars, oxo acids of phosphorus, oxo acids of nitrogen, salts of oxo acids of phosphorus and salts of oxo acids of nitrogen, wherein at least one phosphorus atom or nitrogen atom is present in a medium oxidation stage of said accelerators such that said accelerators have a reducing effect, the aqueous agent (1) having a molar ratio of accelerators to the concentration of cations and/or compounds of metal (A) of at least 1:5; and the cations and/or compounds of metal (A) having a redox potential $E_{redox}$ measured on a metal electrode of the metal (A) at a predetermined process temperature and concentration of cations and/or compounds of the metal (A) in the aqueous agent (1); the galvanized or alloy-galvanized steel surface having an electrode potential $E_{zn}$, when in contact with an aqueous agent (2) differing from the agent (1) only in that the aqueous agent (2) does not contain any cations and/or compounds of the metal (A), wherein the redox potential $E_{redox}$ is more anodic than the electrode potential $E_{zn}$; and optionally one or more additional components:

(c) 0.1 ppm to 50 ppm copper(II) cations;

(d) a nonionic surfactant;

(e) chelating agents;

(f) water-soluble and/or water-dispersible polymer complexing agents with oxygen and/or nitrogen ligands.

33. The method according to claim 32, wherein the redox potential $E_{redox}$ of the cations and/or compounds of the metal (A) in the aqueous agent (1) is more anodic than the electrode potential $E_{zn}$ of the galvanized or alloy-galvanized steel surface in contact with the aqueous agent (2) by at least +50 mV but at most +800 mV.

34. The method according to claim 32, wherein the concentration of cations and/or compounds of the metal (A) is at least 0.01 M but not more 0.2M.

35. The method according to claim 32, wherein iron(II) ions and/or iron(II) compounds are used as the cations and/or compounds of the metal (A).

36. The method according to claim 32, wherein the pH of the aqueous agent (1) is no less than 2 and no greater than 6.

37. The method according to claim 32, wherein the aqueous agent (1itionally contains chelating complexing agents having oxygen and/or nitrogen ligands.

38. The method according to claim 37, wherein the aqueous agent (1) has a molar ratio of chelating complexing agents to the concentration of cations and/or compounds of the metal (A) that is no greater than 5:1 but is at least 1:5.

39. The method according to claim 37, wherein water-soluble and/or water- dispersible polymer compounds, comprising x-(N-$R^1$-N-$R^2$-aminomethyl)-4-hydroxystyrene monomer units are used as the chelating complexing agents, wherein x =2, 3, 5 or 6; $R^1$ is an alkyl group with no more than four carbon atoms, and $R^2$ is a substituent of general empirical formula $H(CHOH)_mCH_2$- with a number m of hydroxymethylene groups of no more than 5 and no less than 3.

40. The method according to claim 32, wherein cations and/or compounds of tin in the oxidation stages +II and/or +IV are used as cations and/or compounds of the metal (A).

41. The method according to claim 32, wherein the pH of the aqueous agent is no less than 4 and no more than 8.

42. The method according to claim 32, wherein the aqueous agent (1) contains accelerators selected from hydrazine, hydroxylamine, nitroguanidine, N-methylmorpholine N-oxide, glucoheptonate, ascorbic acid and reducing sugars.

43. The method according to claim 32, wherein the aqueous agent (1) contains no more than 50 ppm but at least 0.1 ppm copper(II) cations.

44. The method according to claim 32, wherein after contacting the galvanized or alloy-galvanized steel surface with the aqueous agent (1), a metallic coating with metal (A) in a layer coating of at least 1 $mg/m^2$ but no more than 100 $mg/m^2$ is obtained.

45. The method according to claim 32, wherein after contacting the galvanized or alloy-galvanized steel surface with the aqueous agent (1), with or without an intermediate rinsing and/or drying step, a passivating conversion treatment of the metallized pretreated galvanized or alloy-galvanized steel surface is performed by contacting the metallized pretreated galvanized or alloy-galvanized steel surface with a composition different from the aqueous agent (1).

46. The method according to claim 32, wherein the passivating conversion treatment comprises a chromium(VI)-free conversion treatment, in which a conversion layer is created, containing 0.05 to 3.5 mmol of a metal M per square meter of surface area, said metal M constituting an component of the composition different from the aqueous agent (1), whereby the metal M is selected from Cr(III), B, Si, Ti, Zr, Hf and combinations thereof.

* * * * *